US005664053A

United States Patent [19]

Laflamme et al.

[11] Patent Number: 5,664,053

[45] Date of Patent: Sep. 2, 1997

[54] PREDICTIVE SPLIT-MATRIX QUANTIZATION OF SPECTRAL PARAMETERS FOR EFFICIENT CODING OF SPEECH

[75] Inventors: Claude Laflamme, Sherbrooke; Redman Salami, Ascot; Jean-Pierre Adoul, Sherbrooke, all of Canada

[73] Assignee: Universite De Sherbrooke, Sherbrooke, Canada

[21] Appl. No.: 416,019

[22] Filed: Apr. 3, 1995

[51] Int. Cl.[6] ..... G10L 9/14

[52] U.S. Cl. ..... 704/219; 704/222; 704/220; 704/229; 704/230

[58] Field of Search ..... 395/2, 2.31, 2.29, 395/2.28, 2.1, 2.38, 2.39; 381/31, 36, 34, 37, 40, 41, 51, 38, 47, 49

[56] References Cited

U.S. PATENT DOCUMENTS

| | | | |
|---|---|---|---|
| 4,385,393 | 5/1983 | Chaure et al. | 375/30 |
| 4,536,886 | 8/1985 | Papamichalis et al. | 381/41 |
| 4,667,340 | 5/1987 | Arjmand et al. | 381/31 |
| 4,811,398 | 3/1989 | Copperi et al. | 381/37 |
| 4,956,871 | 9/1990 | Swaminathan | 381/31 |
| 4,964,166 | 10/1990 | Wilson | 381/34 |
| 4,969,192 | 11/1990 | Chen et al. | 381/31 |
| 5,067,158 | 11/1991 | Arjmand | 381/51 |
| 5,230,036 | 7/1993 | Akamine et al. | 395/2 |
| 5,351,338 | 9/1994 | Wigren | 395/2.28 |
| 5,384,891 | 1/1995 | Asakawa et al. | 395/2.29 |
| 5,444,816 | 8/1995 | Adoul et al. | 395/2.28 |

FOREIGN PATENT DOCUMENTS

| | | | |
|---|---|---|---|
| A-0 308 817 | 3/1989 | European Pat. Off. | G10L 7/04 |
| A-0 424 121 | 4/1991 | European Pat. Off. | G10L 9/14 |
| A-0 500 076 | 8/1992 | European Pat. Off. | G10L 9/14 |

OTHER PUBLICATIONS

C. Tsao and R. Gray, "Matrix Quantizer Design for LPC Speech Using the Generalized Lloyd Algorithm", IEEE Transactions, ASSP, vol. 33, No. 3, Jun. 1985, pp. 537–545.

R. Salami, C. Laflamme, J-P Adoul and D. Massaloux, "A Toll Quality 8 Kb/s Speech Codec for the Personal Communications System (PCS)", IEEE transactions on Vehicular Technology, vol. 43, No. 3, Aug. 1994, pp. 808–816.

S. Saito and K. Nakato, "Fundamentals of Speech Signal Processing", Academic Press, 1985, pp. 74–83 and 126–132.

J.D. Markel and A.H. Gray, Jr., "Linear Prediction of Speech", Springer-Verlag, 1976, pp. 1–20.

*Primary Examiner*—Allen R. MacDonald
*Assistant Examiner*—Vijay B. Chawan
*Attorney, Agent, or Firm*—Merchant, Gould, Smith, Edell, Welter & Schmidt, P.A.

[57] ABSTRACT

The present invention concerns efficient quantization of more than one LPC spectral models per frame in order to enhance the accuracy of the time-varying spectrum representation without compromising on the coding-rate. Such efficient representation of LPC spectral models is advantageous to a number of techniques used for digital encoding of speech and/or audio signals.

7 Claims, 2 Drawing Sheets

PREDICTIVE SPLIT-MATRIX QUANTIZATION OF SPECTRAL PARAMETERS FOR EFFICIENT CODING OF SPEECH

BACKGROUND OF THE INVENTION

1. Field of the Invention

The present invention relates to an improved technique for quantizing the spectral parameter used in a number of speech and/or audio coding techniques.

2. Brief Description of the Prior Art

The majority of efficient digital speech encoding techniques with good subjective quality/bit rate tradeoffs use a linear prediction model to transmit the time varying spectral information.

One such technique found in several international standards including the G729 ITU-T is the ACELP (Algebraic Code Excited Linear Prediction) [1] technique.

In ACELP like techniques, the sampled speech signal is processed in blocks of L samples called frames. For example, 20 ms is a popular frame duration in many speech encoding systems. This duration translates into L=160 samples for telephone speech (8000 samples/sec), or, into b=320 samples when 7-kHz-wideband speech (16000 samples/sec) is concerned.

Spectral information is transmitted for each frame in the form of quantized spectral parameters derived from the well known linear prediction model of speech [2,3] often called the LPC information.

In prior art related to frames between 10 and 30 ms, the LPC information transmitted per frame relates to a single spectral model.

The accuracy in transmitting the time-varying spectrum with a 10 ms refresh rate is of course better than with a 30 ms refresh rate however the difference is not worth tripling the coding rate.

The present invention circumvents the spectral-accuracy/coding-rate dilemma by combining two techniques, namely: Matrix Quantization used in very-low bitrate applications where LPC models from several frames are quantized simultaneously [4] and an extensions to matrix of inter-frame prediction [5].

References

[1] U.S. Pat. No. 5,444,816 issued Aug. 22, 1995 for an invention entitled "Dynamic Codebook for efficient speech coding based on algebraic code", J-P Adoul & C. Laflamme inventors.

[2] J. D. Markel & A. H. Gray, Jr. "Linear Predication of Speech" Springer Verlag, 1976.

[3] S. Saito & K. Nakata, "Fundamentals of Speech Signal Processing", Academic Press 1985.

[4] C. Tsao and R. Gray, "Matrix Quantizer Design for LPC Speech Using the Generalized Lloyd Algorithm" IEEE trans. ASSP Vol.: 33, No 3, pp 537–545 June 1985.

[5] R. Salami, C. Laflamme, J-P. Adoul and D. Massaloux, "A toll quality 8 Kb/s Speech Codec for the Personal Communications System (PCS)", IEEE transactions of Vehicular Technology, Vol. 43, No. 3, pp 808816, August 94.

OBJECTS OF THE NEW INVENTION

The main object of this invention is a method for quantizing more than one spectral model per frame with no, or little, coding-rate increase with respect to single-spectral-model transmission. The method achieves, therefore, a more accurate time-varying spectral representation without the cost of significant coding-rate increases.

SUMMARY OF THE NEW INVENTION

More specifically, in accordance with the present invention,

A method is defined for efficient quantization of N LPC spectral models per frame. This method is advantageous to enhance the spectral-accuracy/coding-rate trade-off in a variety of techniques used for digital encoding of speech and/or audio signals.

Said method combines the steps of (a) forming a matrix, P, whose rows are the N LPC-spectral-model vectors.

(b) removing from F (possibly a constant-matrix term and) a time-varying prediction matrix, P, based on one, or more, previous frames, to obtain a residual matrix R, and (c) Vector Quantizing said matrix R.

Reduction of the complexity of Vector Quantizing said matrix R, is possible by partitioning said matrix R into q sub matrices, having N rows, and Vector Quantizing independently each sub matrix.

The time-varying prediction matrix, P, used in this method can be obtained using a using non-recursive prediction approach. One very effective method of calculating the time-varying prediction matrix, P, is expressed in the following formula, $$P=A\,R_b'$$

where A is a MXb matrix whose components are scalar prediction coefficients and where $R_b'$ is the bXM matrix composed of the last b rows of matrix R' which resulted from Vector Quantizing the R-matrix of the previous frame.

Note that this time-varying prediction matrix, P, can also be obtained using a recursive prediction approach.

In a variant of said method which lowers coding rate and complexity, the N LPC spectral models per frame correspond to N sub frames interspersed with m−1 sub frames; where the N(m−1) LPC-spectral-model vectors corresponding to said interspersed sub frames are obtained using linear interpolation.

Finally, the N spectral models per frame results from LPC analysis which may use direct window shapes according to the order of a particular spectral model within the frame. This provision, exemplified in FIG. 1, helps make the most out of available information, in particular, when no, or insufficient, "look ahead" (to future samples beyond the frame boundary) is permitted.

DETAILED DESCRIPTION OF THE PREFERRED EMBODIMENT

This invention describes a coding-rate-efficient method for jointly and differentially encoding N (N>1) spectral models per processed frame of L=N×K samples; a frame being subdivided into N sub frames of size K. The method is useful in a variety of techniques used for digital encoding of speech and/or audio signals such as, but not restricted to, stochastic, or, Algebraic-Code-Excited Linear Prediction, Waveform Interpolation, Harmonic/Stochastic Coding techniques.

The method for extracting linear predictive coding (LPC) spectral models from the speech signal is well known in the art of speech coding [1,2]. For telephone speech, LPC models of order M=10 are typically used, whereas models of order M=16 or more are preferred for wideband speech applications.

To obtain an LPC spectral model of order M corresponding to a given sub frame, a $L_A$-sample-long analysis window centered around the given sub frame is applied to the sampled speech. The LPC analysis based on the $L_A$-windowed-input samples produce a vector, f, of M real components characterizing the speech spectrum of said sub frame.

Figure 1:
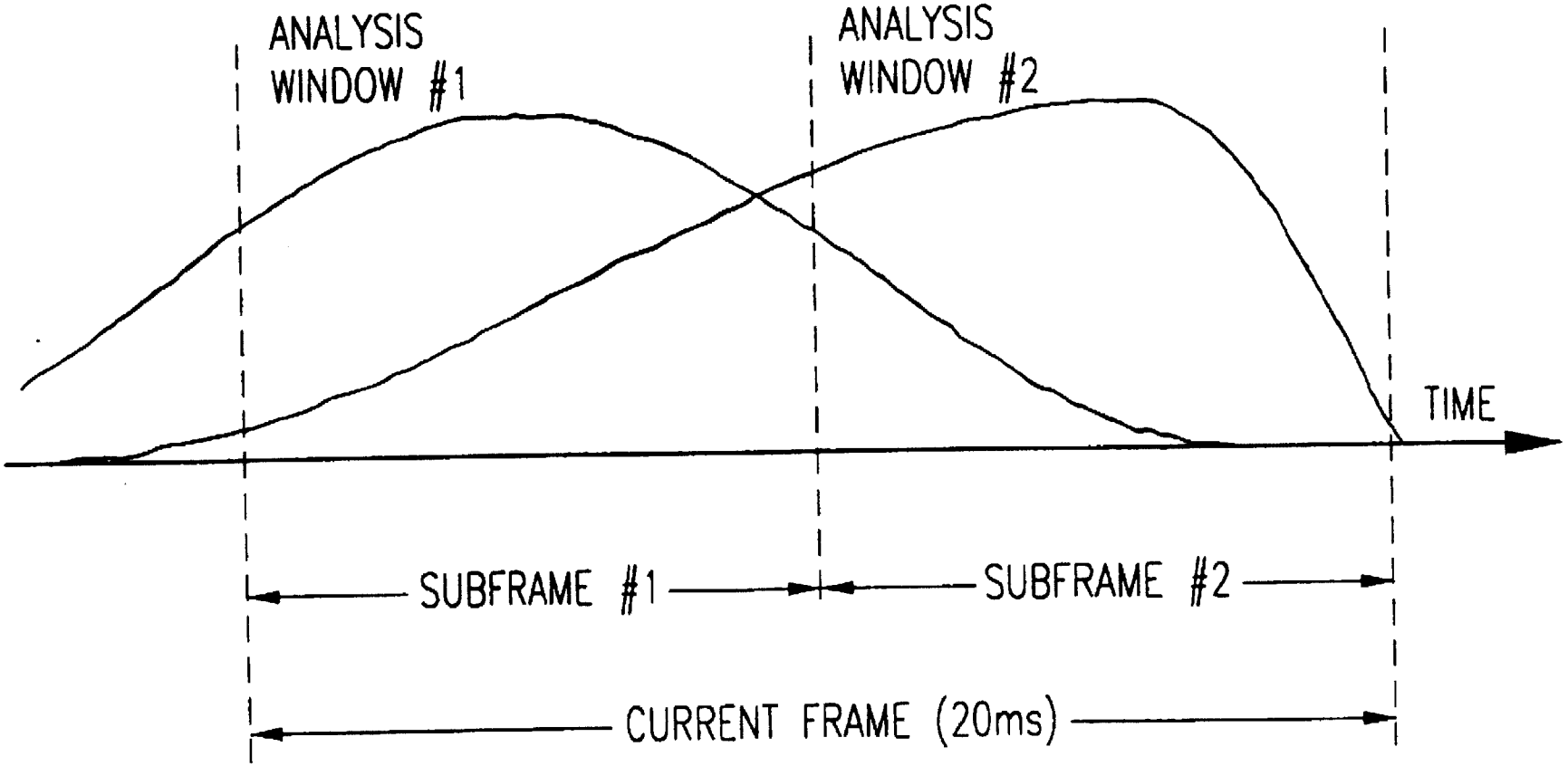
FIG. 1 describes a typical frame & window structure where a 20 ms frame of L=160 sample is subdivided into two sub frames of associated with windows of different shapes.

Typically, a standard Hamming window centered around the sub frame is used with window-size $L_A$ usually greater than sub frame size K. In some cases, it is preferable to use different windows depending on the frame position within the frame. This case is illustrated in FIG. 1. In this Figure, a 20 ms frame of L=160 samples is subdivided into two sub frames of size K=80. Sub frame #1 uses a Hamming window. Sub frame #2 uses an asymmetric window because future speech samples extending beyond the frame boundary are not accessible at the time of the analysis, or, in speech-expert language; no, or insufficient, "look ahead" is permitted. In FIG. 1, window #2 is obtained by combining a half Hamming window with a quarter cosine window.

Various equivalent M-dimensional representations of the LPC spectral model, f, have been used in the speech coding literature. They include, the "partial correlations", the "log-area ratios", the LPC cepstrum and the line Spectrum Frequencies (LSF).

In the preferred embodiment, the LSF representation is assumed, even though, the method described in the present invention applies to any equivalent representations, of the LPC spectral model, including the ones already mentioned, providing minimal adjustments that are obvious to anyone versed in the art of speech coding.

Figure 2:
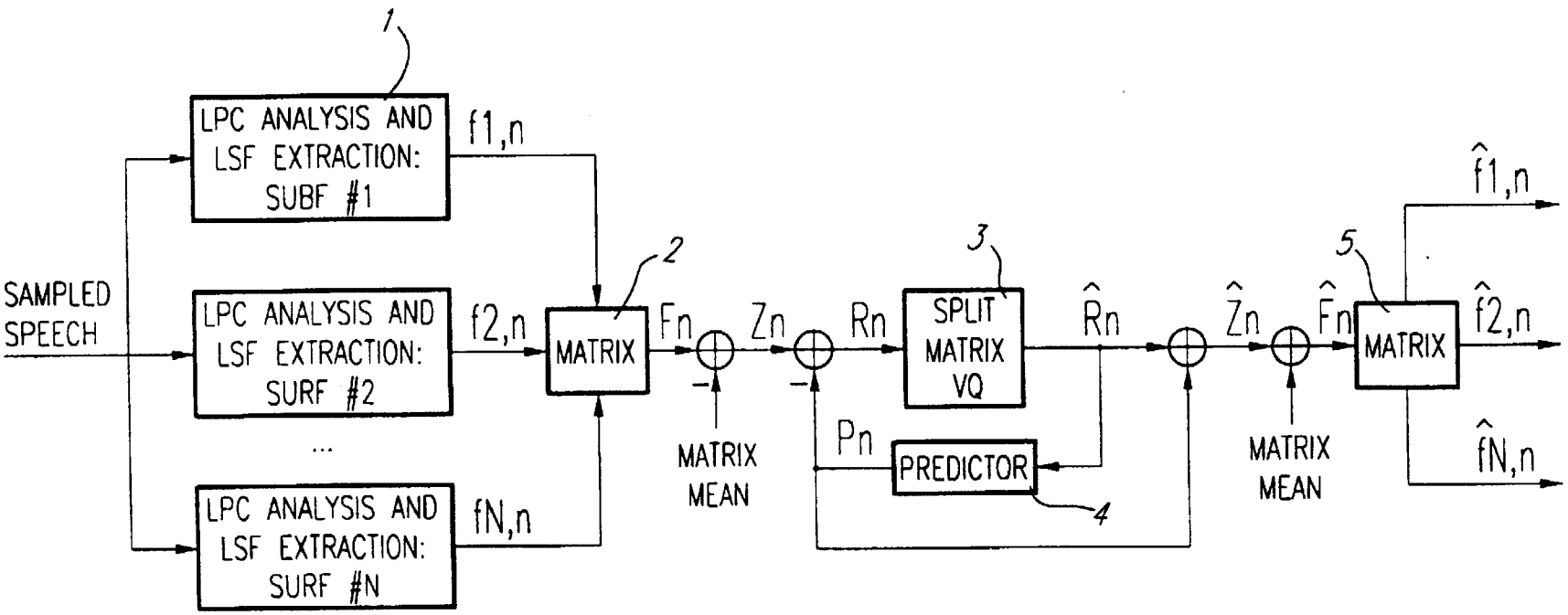
FIG. 2 provides a schematic block diagram of the preferred embodiment.

FIG. 2 describes the steps involved for jointly quantizing N spectral models of a frame according to the preferred embodiment.

STEP 1: An LPC analysis which produces an LSF vector, $f_i$, is performed (in parallel or sequentially) for each sub frame i, (i=1 . . . N).

STEP 2: A matrix, F, of size NXM is formed from said extracted LSF vectors taken as row vectors.

STEP 3: The mean matrix is removed from F to produce matrix Z of size NXM. Rows of the mean matrix are identical to each other and the $j^{th}$ element in a row is the expected value of the $j^{th}$ component of LSF vectors f resulting from LPC analysis.

STEP 4: A prediction matrix, P, is removed from Z to yield the residual matrix R of size NXM. Matrix P infers the most likely values that Z will assume based on past frames. The procedure for obtaining P is detailed in a subsequent step.

STEP 5: The residual matrix R is partitioned into q sub matrices for the purpose of reducing the quantization complexity. More specifically, R is partitioned in the following manner $$R=[V_1 V_2 \ldots V_q],$$

where $V_i$ is a sub matrix of size $NXm_i$ such a way $m_1+m_2 \ldots +m_q=M$.

Each sub matrix $V_i$, considered as an $MXm_i$ vector is vector quantized separately to produce both the quantization index transmitted to the decoder and the quantized sub matrix $V_i'$ corresponding to said index. The quantized residual matrix, R', is reconstructed as $$R'=[V_1' V_2' \ldots V_q']$$

Note that this reconstruction, as well as all subsequent steps, are performed in the same manner at the decoder.

STEP 6: The prediction matrix P is added back to R' to produce Z'

STEP 7: The mean matrix is further added to yield the quantized matrix F'. The $i^{th}$ rows of said F' matrix is the (quantized) spectral model $f_i'$ of sub frame i which can be used profitably by the associated digital speech coding technique. Note that transmission of spectral-model $f_i'$ require minimal coding rate because it is differentially and jointly quantized with the other sub frames.

STEP 8: The purpose of this final test is to determine the prediction matrix P which will be used in processing the next frame. For clarity, we will use a frame index n. Prediction matrix $P_{n+1}$ can be obtained by either the recursive or the non recursive fashion.

The recursive method which is more intuitive operates as a function, g, of past $Z_n'$ vectors, namely $$P_{n+1}=g(Z_n', Z_{n-1}' \ldots)$$

In the embodiment described in FIG. 2, the non-recursive approach was preferred because of its intrinsic robustness to channel error. In this case, the general case can be expressed using function, h, of past $R_n'$ matrices, namely $$P_{n+1}=h(R_n', R_{n-1}' \ldots)$$

The present invention further discloses that the following simple embodiment of the h function captures most predictive information.

$$P_{n+1}=A\ R_b'$$

$$P=A\ R_b'$$

where A is a MXb matrix whose components are scalar prediction coefficients and where $R_b'$ is the bXM matrix composed of the last b rows of matrix R'. (i.e.: corresponding to the last b sub frames of frame n) .

Interpolated sub frames: We now describe a variant of the basic method disclosed in this invention method which spares some coding rate and streamline complexity in the case where a frame is divided in many sub frames.

Consider the case where frames are subdivided into Nm sub frames where N and m are integers (e.g.: 12=4×3 sub frames).

In order to save both coding rate and quantization complexity, the "Predictive Split-Matrix Quantization" method previously described is applied to only N sub frames interspersed with m−1 sub frames for which linear interpolation is used.

More precisely, the spectral models whose index are multiple of m are quantized using Predictive Split-Matrix Quantization.

| | | |
|---|---|---|
| $f_m$ | quantized into | $f_m'$ |
| $f_{2m}$ | quantized into | $f_{2m}'$ |
| ... | ... | ... |
| $f_{km}$ | quantized into | $f_{km}'$ |
| ... | ... | ... |
| $f_{Nm}$ | quantized into | $f_{Nm}'$ |

Note that k=1, 2, . . . N is a natural index for these spectral models that are quantized in this manner.

We now address the "quantization" of the remaining spectral models. To this end we call $f_0'$ the quantized spectral model of the last sub frame of the previous frame (i.e. case k=0). Spectral models with index of the form i×km+j (i.e.: j≠0) are "quantized" by way of linear interpolation of $f_{km}'$ and $f_{(k+1)m}'$ as follows, $$f_{km+j}'=j/m\, f_{km}'+(m-j)/m\, f_{(k+1)m}'$$

where ratios j/m and (m−j)/m are used as interpolation factors.

Although preferred embodiments of the present invention have been described in detail herein above, these embodiments can be modified at will, within the scope of the appended claims, without departing from the nature and spirit of the invention. Also the invention is not limited to the treatment of a speech signal; other types of sound signal such as audio can be processed. Such modifications, which retain the basic principle, are obviously within the scope of the subject invention.

The embodiments of the invention in which an exclusive property or privilege is claimed are defined as follows:

1. A method for jointly quantizing N linear-predictive-coding spectral models per frame of a sampled sound signal, in which N>1, in view of enhancing a spectral-accuracy/coding-rate trade-off in a technique for digitally encoding said sound signal, said method comprising the following combination of steps:

(a) forming a matrix, F, comprising N rows defining N vectors representative of said N linear-predictive-coding spectral models, respectively;

(b) removing from the matrix F a time-varying prediction matrix, P, based on at least one previous frame, to obtain a residual matrix, R; and (c) vector quantizing said residual matrix R.

2. A method as defined in claim 1, wherein, to reduce the complexity of vector quantizing said residual matrix R, step (c) comprises the steps of partitioning said residual matrix R into a number of q sub matrices, having N rows, and vector quantizing independently each sub matrix.

3. A method as defined in claim 1, comprising the step of obtaining said time-varying prediction matrix P using a non-recursive prediction approach.

4. A method as defined in claim 3, wherein said non-recursive prediction approach consists of calculating the time-varying prediction matrix P according to the following formula, $$P=A\, R_b'$$

where A is a Mxb matrix, M and b being integers, whose components are scalar prediction coefficients and where $R_b'$ is a bxM matrix composed of the last b rows of a matrix, R', resulting from vector quantizing the residual matrix R of the previous frame.

5. A method as defined in claim 1, wherein said N linear-predictive-coding spectral models per frame correspond to N sub frames interspersed with m−1 sub frames, m being an integer, and wherein said vectors representative of said linear-predictive-coding spectral models corresponding to said interspersed sub frames are obtained using linear interpolation.

6. A method as defined in claim 1, further comprising the step of obtaining the time-varying prediction matrix P using a recursive prediction approach.

7. A method as defined in claim 1, wherein said N linear-predictive-coding spectral models per frame results from a linear-predictive-coding analysis using different window shapes according to the order of a particular spectral model within the frame.

* * * * *

UNITED STATES PATENT AND TRADEMARK OFFICE
CERTIFICATE OF CORRECTION

PATENT NO. : 5,664,053

DATED : SEPTEMBER 2, 1997

INVENTOR(S) : LAFLAMME ET AL.

It is certified that error appears in the above-identified patent and that said Letters Patent is hereby corrected as shown below:

Title page [75] Inventors: "Redman" should read --Redwan--

Col. 1, line 25: "b=" should read --L=--

Col. 2, line 45: "direct" should read --different--

Col. 3, line 23: insert --sub-- after the word "the"

Col. 4, line 3: insert --in-- after the word "$NXm_i$"

Col. 4, line 3: insert --that-- after the word "way"

Signed and Sealed this

Twelfth Day of May, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,664,053
APPLICATION NO. : 08/416019
DATED : September 2, 1997
INVENTOR(S) : Laflamme et al.

It is certified that error appears in the above-identified patent and that said Letters Patent is hereby corrected as shown below:

Col. 2, line 32: "MXb" should read --NXb--

Col. 4, line 5: "$MXm_i$" should read --$NXm_i$--

Col. 4, line 51: "MXb" should read --NXb--

Col. 6, line 22, claim 4: "Mxb" should read --Nxb--

Signed and Sealed this

Eighth Day of May, 2007

JON W. DUDAS
*Director of the United States Patent and Trademark Office*